US007147176B2

(12) United States Patent
Rexhaj

(10) Patent No.: US 7,147,176 B2
(45) Date of Patent: Dec. 12, 2006

(54) DEVICE AND METHOD FOR UNREELING WIRE FROM A WIRE COIL

(75) Inventor: Fahredin Rexhaj, Sundsbruk (SE)

(73) Assignee: Metso Paper, Inc. (FI)

( * ) Notice: Subject to any disclaimer, the term of this patent is extended or adjusted under 35 U.S.C. 154(b) by 256 days.

(21) Appl. No.: 10/477,368

(22) PCT Filed: Apr. 18, 2002

(86) PCT No.: PCT/SE02/00761

§ 371 (c)(1),
(2), (4) Date: May 13, 2004

(87) PCT Pub. No.: WO02/092488

PCT Pub. Date: Nov. 21, 2002

(65) Prior Publication Data

US 2004/0188559 A1 Sep. 30, 2004

(30) Foreign Application Priority Data

May 17, 2001 (SE) ..... 0101787

(51) Int. Cl.
*B65H 49/00* (2006.01)

(52) U.S. Cl. ..... 242/128; 242/417.1

(58) Field of Classification Search ..... 242/128, 242/593, 156.2, 419.1, 417.1
See application file for complete search history.

(56) References Cited

U.S. PATENT DOCUMENTS 1,873,422 A * 8/1932 Keller ..... 242/128
2,419,808 A 4/1947 Wirth
2,643,075 A * 6/1953 Moore ..... 242/128
2,673,046 A * 3/1954 Lewis ..... 242/128
2,772,840 A * 12/1956 Goodhue et al. ..... 242/128
2,942,802 A * 6/1960 Bachus ..... 242/128
3,018,066 A * 1/1962 Crum ..... 242/128
3,567,152 A * 3/1971 Heisler ..... 242/128
3,655,108 A * 4/1972 Bonnabaud et al. ..... 242/128
4,423,588 A 1/1984 Garcia
4,681,277 A 7/1987 Kosch
5,040,741 A * 8/1991 Brown ..... 242/128
5,806,780 A * 9/1998 Schneider et al. ..... 242/128
6,409,116 B1 * 6/2002 Brown ..... 242/419.1

FOREIGN PATENT DOCUMENTS

JP 3-128867 * 5/1991
SE 509 532 A1 10/1993

* cited by examiner

*Primary Examiner*—William A. Rivera
(74) *Attorney, Agent, or Firm*—Lerner,David,Littenberg,Krumholz & Mentlik, LLP

(57) ABSTRACT

A wire consumer, such as a bale binder, draws wire from a wire coil on an unreeling device. The entire unreeling device is mounted on a wheel-supported frame, and it comprises a wire loop and an acceleration balancer which is effective when the wire consumer starts to draw wire out from the unreeling device. The wire loop comprises a wheel, which is loaded by a spring, and an air cylinder, which is coupled to the wheel for damping the acceleration of the wheel.

8 Claims, 3 Drawing Sheets

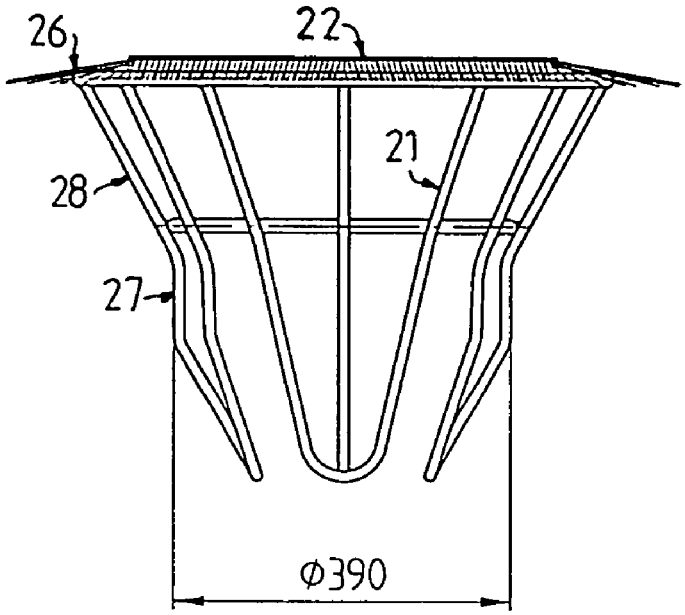
FIG. 4
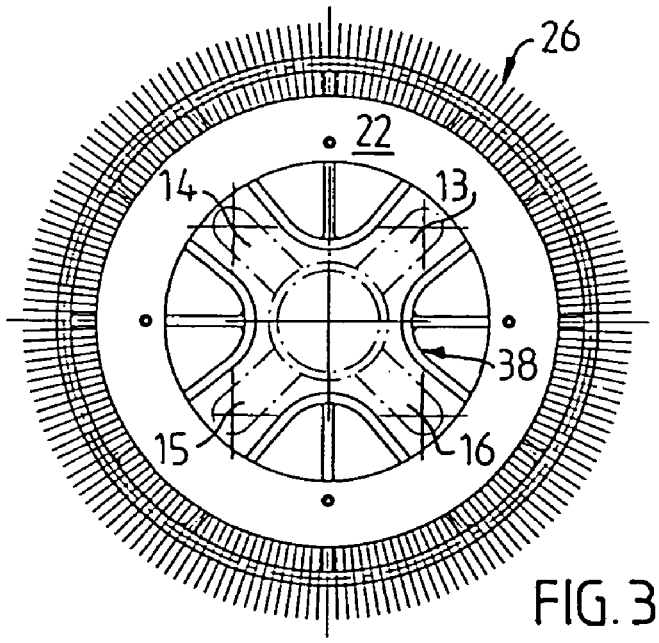
FIG. 3
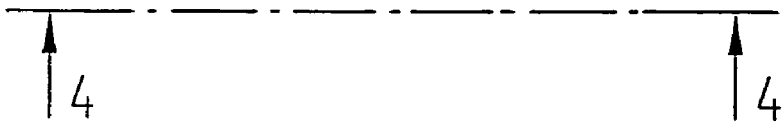

DEVICE AND METHOD FOR UNREELING WIRE FROM A WIRE COIL

FIELD OF THE INVENTION

The present invention relates to an unreeling device for reeling off wire from a wire coil. More particularly, the present invention also relates to a method of reeling off wire from a wire coil to a bale binder by letting the bale binder intermittently draw the wire from the wire coil.

BACKGROUND OF THE INVENTION

Bale binders, for example those described in Swedish Patent No. 509,532, operate intermittently and feed wire for binding it around a bale, for example a paper pulp bale. After a first binding around operation, the bale is usually moved for a new binding around operation in parallel with and at a distance from the first one. The cycle time of the bale binder can be less than 5 seconds, and it could be reduced still more if the wire speed and wire acceleration could be increased, but then the risk of snarling and knot formation on the wire at the reeling-off device increases. The acceleration and speed of the wire, therefore, must be balanced against the risk of process interruption.

One object of the present invention is to render it possible to achieve higher wire acceleration and wire speed during intermittent unreeling of wire from a wire coil.

SUMMARY OF THE INVENTION

In accordance with the present invention, this and other objects have now been realized by the invention of apparatus for unreeling wire from a wire coil comprising mounting means for mounting the wire coil, loop means for creating a loop of the wire extending in a predetermined plane as the wire is unreeled from the mounting means, the loop means including at least one wheel over which the wire runs while being unreeled through the loop, and acceleration balancing means for moving the at least one wheel in the predetermined plane whereby when the at least one wheel moves in a first direction in the predetermined plane the length of the loop decreases and in a second direction in the predetermined plane the length of the loop increases, the acceleration balancing means loading the wheel in the first direction. Preferably, the acceleration balancing means includes a spring for loading the wheel in the first direction, and damping means coupled to the at least one wheel for damping the acceleration of the wheel. In a preferred embodiment, the damping means comprises an air cylinder including a throttle for connecting the cylinder to the atmosphere. Preferably, the air cylinder comprises a double acting air cylinder including a pair of cylinder chambers, each of the pair of cylinder chambers including a throttle for connecting the cylinder chamber to the atmosphere.

In accordance with one embodiment of the apparatus of the present invention, the mounting means comprises a frame, a stand mounted on the frame for the wire coil, a swivel coaxially mounted with respect to the stand for guiding the wire from the wire coil through the stand, and guide means for guiding the wire from the stand to the acceleration balancing means, the acceleration balancing means being mounted on the frame adjacent to the stand. Preferably, the apparatus includes a ring including outwardly directed bristles disposed on the stand between the wire coil and the swivel, the ring being coaxially disposed with respect to the wire coil, whereby the wire is drawn along the outwardly directed bristles during the unreeling of the wire.

In accordance with the present invention, a method as also been discovered for unreeling wire from a wire coil to a bale binder whereby the bale binder can intermittently unreel from the wire coil, the method comprising forming the wire into a wire loop during the unreeling of the wire, loading the wire loop against increasing the length of the wire loop, and adjusting the loading of the wire in response to the intermittent operation of the bale binder, whereby the length of the wire loop decreases when the bale binder draws the wire from the wire loop and retains its length until the bale binder stops drawing the wire from the wire coil. Preferably, the method includes guiding the wire from the wire coil upwardly over a swivel, and downwardly through the wire coil and then outwardly therefrom into the wire loop.

In accordance with the present invention, the objects thereof are achieved by associating with the unreeling device acceleration balancing means in the form of a wheel, over which the reeled off wire runs back and forth in a loop, where the wheel is movable substantially in the direction of the loop, such that during movement in one direction the loop length is reduced and during movement in the other direction the loop length is increased, and the wheel is loaded in that one direction. One object of this invention is, during unreeling to a bale binder, to allow the bale binder to draw the wire at a higher acceleration and top speed from the unreeling device. This is achieved in principle by letting the wire run in a loop, which is loaded against increased loop length, and adjusting the load to the operation cycle of the bale binder, so that the loop length decreases when the bale binder draws wire, and retains its size until the bale binder ceases to draw wire. The loop length decreases when the bale binder draws wire and retains its size until the bale binder ceases to draw wire.

BRIEF DESCRIPTION OF THE DRAWINGS

FIG. 3 is a top, elevational, enlarged view of a portion of the embodiment of the present invention shown in FIG. 1;

FIG. 4 is a side, elevational view of the portion of the present invention shown in FIG. 3, taken along lines 4—4 thereof;

DETAILED DESCRIPTION

Figure 1:
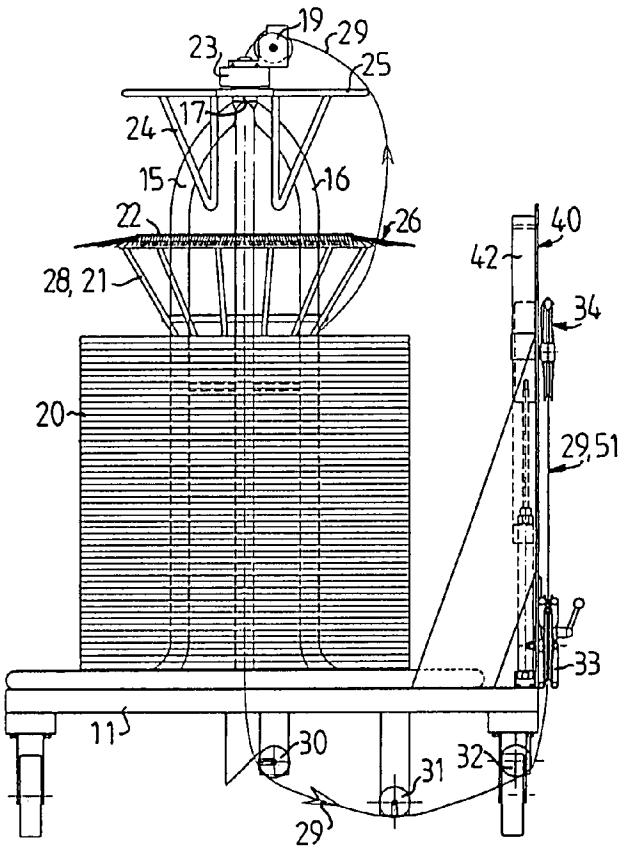
FIG. 1 is a front, elevational view of an unreeling device in accordance with one embodiment of the present invention.
Figure 2:
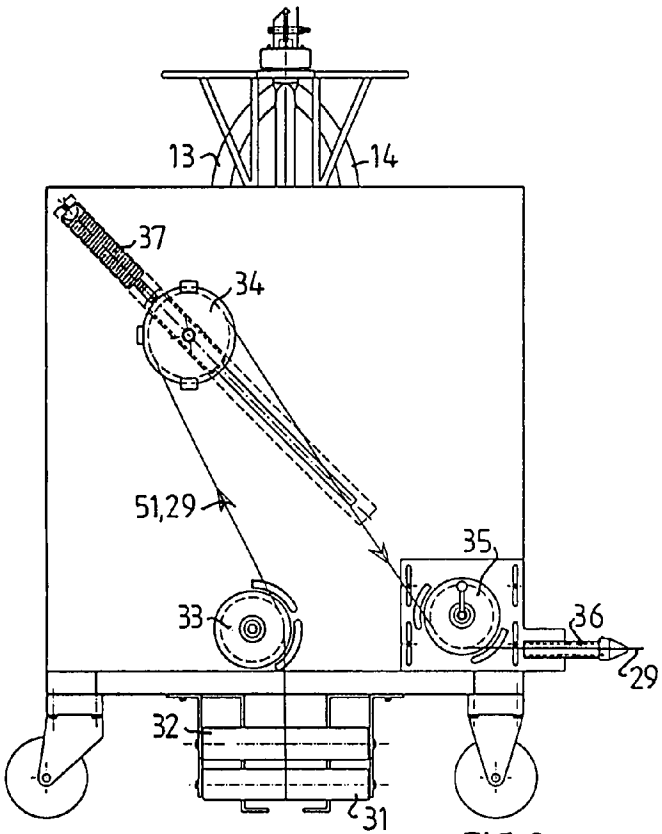
FIG. 2 is a side, elevational view of the embodiment of the present invention shown in FIG. 1.

The unreeling device shown in the Figures comprises a wheel-supported steel frame 11 with an upright wire coil stand consisting of four pipes, 13–16, the tops of which are bent inward towards and welded onto a sleeve 17. A coil 20 with wire, usually steel wire, is threaded on the wire coil stand 13–16, and a conical pipe structure 21 with a plastic ring 22 rests on the upper portion of the wire coil 20. The sleeve 17 carries a swivel 23 and a pipe structure 24 with a ring 25. The swivel has an eccentrically located guide wheel 19, the horizontal axis of which extends perpendicularly to the vertical axis of the sleeve 17. The pipe structure 21 is conical, but has a straight portion 27 with a slightly smaller diameter than the inner diameter of the wire coil 20. The pipe structure 21 is inserted into the wire coil 20, so that its straight portion 27 is guided by the wire coil, and the conical portion 28 above the straight portion rests on the wire coil. The pipe structure 21 is thereby fixed in the wire coil, but it can follow along with the upper portion of the wire coil downwardly when the wire coil gets shorter during the reeling-off operation. The pipe structure 21 is prevented from turning by the pipes 13–16 being located between four inwardly bent supports 38.

The plastic ring 22 is shown enlarged in FIGS. 3 and 4. It has cast-in wires, which project out radially around its periphery as a rim of bristle 26. The wires are of a wear-resistant and flexible material, suitably a plastic, such as nylon, and their diameter should exceed 1 mm and can, for example, be from about 1 to 2 mm. Their projecting length can suitably be between about 7 and 10 cm, and they can be arranged in one row as shown or in several rows. The plastic ring 22 is screwed onto the pipe structure 21, and the ring of bristle 26 will always have the same position in relation to the upper end of the wire coil when the upper end moves lower during the unreeling operation, because the pipe structure 21 rests on the wire coil with its conical portion 28 being located above the guiding straight portion 27. This design prevents the wire from being clamped during the unreeling operation.

The wire 29 from the coil is led in an arc up to the guide wheel 19 of the swivel 23 and down through the sleeve 17, and from there down through the wire coil to a guide roller 30 and over two more guide rollers, 31 and 32, and up to a guide wheel 33, and further over two guide wheels, 34 and 35, to an outlet guide 36. The guide wheels, 33 and 35, are mounted on a vertical plate 40, which is attached to the steel frame 11, and the guide wheel 34 is attached to a slide 41, which slides in a guide 42, which is attached to the plate 40.

Figure 6:
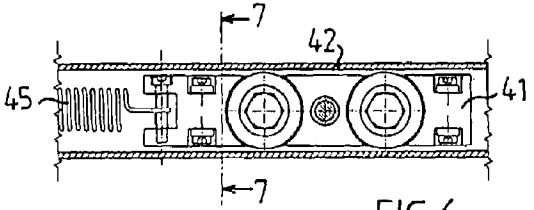
FIG. 6 is a side, elevational, sectional view of the portion of the embodiment of the present invention shown in FIG. 5, taken along line 6—6 thereof.
Figure 7:
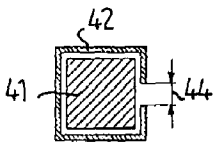
FIG. 7 is a front, elevational, sectional view of the portion of the embodiment of the present invention shown in FIG. 6, taken along line 7—7 thereof.
Figure 5:
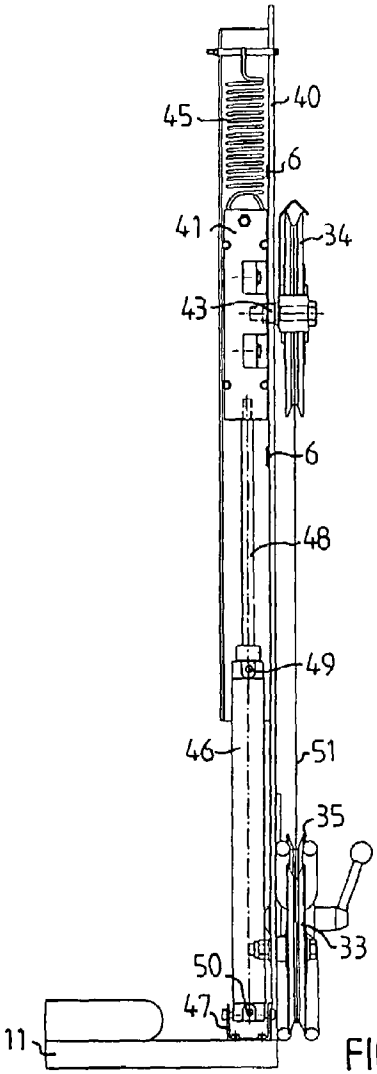
FIG. 5 is a side, elevational, enlarged view of another portion of the embodiment of the present invention shown in FIG. 1.

FIG. 5 is a longitudinal section through the guide 42. As appears most clearly from FIGS. 5–7, the guide 42 has the form of a slotted pipe. The guide wheel 34 is attached onto a stud 43, which is fixed in the slide 41 and extends out through the slot 44 of the guide 42. The slide is attached onto a tension spring 37, which tends to draw the slide up to the end position, in which it is shown in all of the Figures, so that the guide wheels, 33, 34, and 35, together form the wire to a balancing loop 51. An air cylinder 46 is attached to a bracket 47, which is attached to the frame 11, and the plate 40 is also attached to the bracket 47. The air cylinder 46 has its piston rod 48 attached to the slide 41, and the air cylinder has two throttled inlets/outlets, 49 and 50, leading directly to the atmosphere. The entire unreeling device is, as it appears, very compact, and all details are carried on the wheel-supported frame 11, so that the unreeling device can easily be moved as one unit. When a wire coil is emptied, the entire unreeling device can easily be exchanged for a unreeling device with a full wire coil. As the wire end projects out of the outlet guide 36, the exchange can be carried out very rapidly.

In its non-operative position, when no wire is drawn from the outlet guide 36, the slide 41 and, thus, the guide wheel 34, are in the position shown in the Figures, and the wire loop 51 between the wheels 33 and 35 and over the wheel 34 then has its maximum length. When the wire consumer suddenly starts drawing wire from the outlet guide 36, the wire tension will draw down the guide wheel 34 and the slide 41 to the guide wheels 33 and 35, so that the wire loop 51 decreases and at the same time the unreeling from the wire coilbegins. The spring force from the tension spring 37 is initially small, and at the same time the air cylinder 46 initially has no braking effect, because there is atmospheric pressure in both chambers of the cylinder. The braking effect of the cylinder depends on the pressures in both cylinder chambers, and these pressures, in turn, depend on the speed of the piston rod and distance run, because the inlets/outlets, 49 and 50, constitute constant throttles. The braking effect of the cylinder thus increases at the same time as the braking spring force increases, as the guide wheel 34 accelerates towards the guide wheels, 33 and 35, and causes the length of the balancing loop 51 to decrease. When the wire then suddenly stops being drawn from the outlet guide 36, the cylinder 46 initially will co-operate with the spring 37 in order to draw back the guide wheel 34 and thereafter begin to brake movement of the guide wheel 34 at the same time as the spring force decreases.

A bale binder causes high acceleration on the wire at the outlet guide 36, but the controlled movement of the guide wheel 34 implies that the wire acceleration at the wire coil will be much lower, because the length or size of the balancing loop 51 decreases during the acceleration. When the bale binder then suddenly stops the wire feed, the kinetic energy will imply that the unreeling does not stop equally suddenly, but the wire length caused by the difference in deceleration is taken up by the increasing balancing loop, which reduces the risk of snarls and knots. The present invention, therefore, renders possible better accessibility and increased wire feed speed. The wire feed speed can exceed about 4.5 m/s without risk of interruption of the process even when an entire binding cycle takes less than 5 seconds. When the bale binder draws the wire with an acceleration, which becomes a constantly high speed during the final phase of the wire feed, the guide wheel must not move upwardly so much before the feed stop that the loop 52 is so great that after the feed stop it cannot take up all surplus wire. It is therefore necessary to adjust the spring 37 and brake cylinder 46 to the properties of the bale binder, so that the load on the guide wheel 34, and thereby on the balancing loop 51, is adjusted to the operation cycle of the wire consumer/bale binder.

When the bale binder draws the wire 29 from the outlet guide 36 of the unreeling device by means of the guide wheels, 33–35, the guide wheel 19 of the swivel 23 will follow along in the unreeling of the wire, and the wire 29 will skid against the ring of bristle 26 and against the steel ring 25. The bristle ring 26 of the unreeling device also reduces the risk of snarls and knot formation, because it continuously brakes the wire 29. At the same time as the bristle ring constitutes a brake with sufficient braking effect during sudden stops, it does not cause a detrimental braking effect at the start. Too strong a braking effect at the start could cause wire fracture. The bristle ring 26, therefore, increases the accessibility still more.

Although the invention herein has been described with reference to particular embodiments, it is to be understood that these embodiments are merely illustrative of the principles and applications of the present invention. It is therefore to be understood that numerous modifications may be made to the illustrative embodiments and that other arrangements may be devised without departing from the spirit and scope of the present invention as defined by the appended claims.

The invention claimed is:

1. Apparatus for unreeling wire from a wire coil comprising mounting means for mounting said wire coil, loop means for creating a loop of said wire extending in a predetermined plane as said wire is unreeled from said mounting means, said loop means including at least one wheel over which said wire runs while being unreeled through said loop, and acceleration balancing means for moving said at least one wheel in said predetermined plane whereby when said at least one wheel moves in a first direction in said predetermined plane the length of said loop decreases and in a second direction in said predetermined plane the length of said loop increases, said acceleration balancing means loading said wheel in said first direction.

2. The apparatus of claim 1 wherein said acceleration balancing means includes a spring for loading said wheel in said first direction, and damping means coupled to said at least one wheel for damping the acceleration of said wheel.

3. The apparatus of claim 2 wherein said damping means comprises an air cylinder including a throttle for connecting said cylinder to the atmosphere.

4. The apparatus of claim 3 wherein said air cylinder comprises a double acting air cylinder including a pair of cylinder chambers, each of said pair of cylinder chambers including a throttle for connecting said cylinder chamber to the atmosphere.

5. The apparatus of claim 1 wherein said mounting means comprises a frame, a stand mounted on said frame for said wire coil, a swivel coaxially mounted with respect to said stand for guiding said wire from said wire coil through said stand, and guide means for guiding said wire from said stand to said acceleration balancing means, said acceleration balancing means being mounted on said frame adjacent to said stand.

6. The apparatus of claim 5 including a ring including outwardly directed bristles disposed on said stand between said wire coil and said swivel, said ring being coaxially disposed with respect to said wire coil, whereby said wire is drawn along said outwardly directed bristles during said unreeling of said wire.

7. A method for unreeling wire from a wire coil to a bale binder whereby said bale binder can intermittently unreel from said wire coil, said method comprising forming said wire into a wire loop during said unreeling of said wire, loading said wire loop against increasing the length of said wire loop, and adjusting said loading of said wire in response to said intermittent operation of said bale binder, whereby the length of said wire loop decreases when said bale binder draws said wire from said wire loop and retains its length until said bale binder stops drawing said wire from said wire coil.

8. The method of claim 7 including guiding said wire from said wire coil upwardly over a swivel, and downwardly through said wire coil and then outwardly therefrom into said wire loop.

* * * * *